US011686006B2

(12) United States Patent
Lifschitz Arribio et al.

(10) Patent No.: US 11,686,006 B2
(45) Date of Patent: Jun. 27, 2023

(54) METHOD OF ENHANCING COPPER ELECTROPLATING

(71) Applicant: Rohm and Haas Electronic Materials LLC, Marlborough, MA (US)

(72) Inventors: Alejo M. Lifschitz Arribio, Waltham, MA (US); Jonathan D. Prange, Lincoln, MA (US); Michael K. Gallagher, Hopkinton, MA (US); Alexander Zielinski, Charlton, MA (US); Luis A. Gomez, Holden, MA (US); Joseph F. Lachowski, Sutton, MA (US)

(73) Assignee: ROHM AND HAAS ELECTRONIC MATERIALS LLC, Marlborough, MA (US)

( * ) Notice: Subject to any disclaimer, the term of this patent is extended or adjusted under 35 U.S.C. 154(b) by 0 days.

(21) Appl. No.: 17/711,152

(22) Filed: Apr. 1, 2022

(65) Prior Publication Data

US 2022/0228282 A1 Jul. 21, 2022

Related U.S. Application Data

(62) Division of application No. 17/026,514, filed on Sep. 21, 2020, now Pat. No. 11,512,406.

(60) Provisional application No. 62/916,478, filed on Oct. 17, 2019.

(51) Int. Cl.

| | |
|---|---|
| ***C25D 3/38*** | (2006.01) |
| ***C25D 5/34*** | (2006.01) |
| ***C25D 5/48*** | (2006.01) |

(52) U.S. Cl.
CPC ..... *C25D 3/38* (2013.01); *C25D 5/34* (2013.01)

(58) Field of Classification Search
CPC ..... C25D 3/38; C25D 5/34; C25D 5/48
USPC ..... 205/215, 221, 210, 223
See application file for complete search history.

(56) References Cited

U.S. PATENT DOCUMENTS

| | | | | |
|---|---|---|---|---|
| 8,197,662 | B1 | 6/2012 | Webb et al. | |
| 2010/0015805 | A1* | 1/2010 | Mayer | H01L 21/288 438/692 |
| 2010/0320081 | A1* | 12/2010 | Mayer | C25D 7/123 134/198 |
| 2014/0302671 | A1* | 10/2014 | Duong | C23F 1/34 438/653 |
| 2015/0140814 | A1 | 5/2015 | Thorum | |

FOREIGN PATENT DOCUMENTS

| | | | | |
|---|---|---|---|---|
| GB | 2203387 | A * | 10/1988 | C23F 1/18 |
| JP | 2012169597 | A | 9/2012 | |
| WO | WO-2006053242 | A2 * | 5/2006 | C25D 3/38 |

OTHER PUBLICATIONS

Mittapally et al., "Metal Ions as Antibacterial Agents," Journal of Drug Delivery and Therapeutics (Dec. 15, 2018), vol. 8, No. 6-s, pp. 411-419. (Year: 2018).*

(Continued)

*Primary Examiner* — Edna Wong
(74) *Attorney, Agent, or Firm* — John J. Piskorski

(57) ABSTRACT

Crystal plane orientation enrichment compounds are applied to copper to modify copper grain orientation distribution to the favorable crystal plain orientation to enhance copper electroplating. Electroplating copper on the modified copper enables faster and selective electroplating.

12 Claims, 3 Drawing Sheets

(56) References Cited

OTHER PUBLICATIONS

Nishat et al., "Synthesis and Characterization of Antibacterial Polychelates of Urea-Formaldehyde Resin with Cr(III), Mn(II), Fe(III), Co(II), Ni(II), Cu(II), and Zn(II) Metal Ions," Journal of Applied Polymer Science (Apr. 15, 2006), vol. 100, No. 2, pp. 928-936. (Year: 2006).*

Nageswar, "Electrodeposition of Copper on a Copper Single Crystal (111) Face in the Presence of Chloride Ions," Electrodeposition and Surface Treatment (Sep. 1, 1975), vol. 3, Nos. 5-6, pp. 357-367. (Year: 1975).*

Duggan et al., "On the Origin of Cube Texture in Copper," Acta Metallurgica et Materialia, (Jun. 1, 1993), vol. 41, No. 6, pp. 1921-1927. (Year: 1993).*

Hara et al., "Control of the (111) Orientation in Copper Interconnection Layer," Electrochemical and Solid-State Letters (Jan. 16, 2002), vol. 5, No. 3, pp. C41-C43. (Year: 2002).*

* cited by examiner

METHOD OF ENHANCING COPPER ELECTROPLATING

The present application is a divisional patent application of non-provisional patent application Ser. No. 17/026,514, filed Sep. 21, 2020, now U.S. Pat. No. 11,512,406, which claims the benefit of provisional patent application Ser. No. 62/916,478, filed Oct. 17, 2019.

FILED OF THE INVENTION

The present invention is directed to a method of enhancing copper electroplating by modifying copper grain orientation distribution to a favorable crystal plane to improve copper electroplating. More specifically, the present invention is directed to a method of enhancing copper electroplating by modifying copper grain orientation distribution to a favorable crystal plain to improve copper electroplating with crystal plane orientation enrichment compounds.

BACKGROUND OF THE INVENTION

Packaging and interconnection of electronic components relies on the ability to create conductive circuits within a dielectric matrix and fill them with a metal capable of transmitting electrical signals, such as copper. Traditionally, these circuits are built through a photoresist pattern, wherein the process of exposure through a patterned mask, and subsequent removal of the exposed material, leads to the formation of a network of recessed features over a conductive seed. These features can be filled with copper by electroplating on top of a conductive seed such that, after removal of the photoresist and etch-back of the seed, free-standing conductor patterns are obtained on an undelaying surface. Features in these circuits typically include lines, vias, pillars and through-holes of various dimensions.

Alternatively, features might be drilled through a dielectric, either mechanically or by laser ablation. The whole surface can then be conformally coated with a conductive seed; and a similar process of copper electroplating ensues filling the features with electroplated copper to form the circuit. In both photoresist or drill-driven processes, the electroplating parameters should be optimized in order to direct how the copper deposit grows inside the patterned features. Ideally, the conductor is selectively deposited inside features, and minimally on the surface to decrease consumption and subsequent polishing costs. For the same reasons, it is also desired that the feature fill rate of recessed features remains constant throughout the surface, even when features of different sizes and depths are present.

The conventional method for selective deposition inside recessed features relies on controlling the activity of trace additives in the electroplating bath. These additives influence the plating rate by surface adsorption, and their access to the surface can be tuned through a number of variables that affect their diffusion capabilities and to changes in electric filed distribution. For example, a suppressor additive that reduces plating rate can be employed to increase plating rate inside a small feature (where surface access is minimal) and decrease plating rate outside the feature (where surface diffusion is less restricted). As the feature sizes change, the activity of the plating additives can be tuned to adapt to the changing contrast in diffusion capabilities. For example, the concentration of additives; their molecular design; agitation; the loading of inorganic components; or the way in which current is applied might all be changed to maximize and homogenize feature fill.

As the shape, size and complexity of circuits increases, conventional approaches to pattern formation and fill are becoming unsatisfactory in the industry. For example, plating rate control by diffusion differentiation is very useful when feature aspect ratio is high, i.e. >1:1. When the feature aspect ratio decreases significantly, as in advanced packaging circuits, diffusion differentiation is virtually nonexistent in wide, shallow recesses. Even more problematic are circuits that contain features of dissimilar dimensions in a single circuit layer. Thus, each feature dimension often requires a different set of plating bath variables to maximize fill. In many cases, the variables are different enough such that it is very difficult to fill all types of features at once, thus increasing the manufacturing cost. Finally, fill uniformity is often complicated by the heterogeneity in electric field distribution that accompanies surface and feature shape. That is, plating rate can vary locally as a response to edges, corners, density of features and contortions in the pattern, such that combinations of features of different shapes induce large variation in fill rates.

Accordingly, there is a need for a method to control plating rates, to more efficiently plate features which vary in size, shape and aspect ratio, and modify copper electroplating bath components to achieve desired copper electroplating performance.

SUMMARY OF THE INVENTION

The present invention is directed to a method comprising: a) providing a substrate comprising copper; b) applying a composition to the copper of the substrate to increase exposed copper grains having a crystal plane (111) orientation on the copper, wherein the composition consists of water, a crystal plane (111) orientation enrichment compound, optionally a pH adjusting agent, optionally an oxidizing agent, and optionally a surfactant; and c) electroplating copper on the copper having increased exposed copper grains having a crystal plane (111) orientation with a copper electroplating bath.

The present invention is also directed to a method comprising: a) providing a substrate comprising copper; b) applying a composition to the copper of the substrate to increase exposed copper grains having a crystal plane (111) orientation on the copper, wherein the composition consists of water, a crystal plane (111) orientation enrichment compound chosen from quaternary amines, optionally a pH adjusting agent, optionally an oxidizing agent, and a surfactant; and c) electroplating copper on the copper having increased exposed copper grains having a crystal plane (111) orientation with a copper electroplating bath.

The present invention is further directed to a method comprising: a) providing a substrate comprising copper; b) applying a composition to the copper of the substrate to increase exposed copper grains having a crystal plane (111) orientation, wherein the composition consists of water, a crystal plane (111) orientation enrichment compound chosen from a quaternary ammonium compound having the formula:

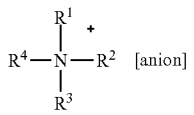

(I)

wherein $R^1$-$R^4$ are independently chosen from hydrogen, $C_1$-$C_5$ alkyl and benzyl, with the proviso that up to three of $R^1$-$R^4$ can be hydrogen at the same instance, optionally a pH adjusting agent, optionally an oxidizing agent, and optionally a surfactant; and (c) electroplating copper on the copper having increased exposed copper grains having a crystal plane (111) orientation with a copper electroplating bath.

The present invention is further directed to a method comprising: a) providing a substrate comprising copper; b) selectively applying a composition to the copper of the substrate to increase exposed copper grains having crystal plane (111) orientations, wherein the composition consists of water, a crystal plane (111) orientation enrichment compound, optionally a pH adjusting agent, optionally an oxidizing agent and optionally a surfactant; and c) electroplating copper on the copper of the substrate having increased exposed copper grains having crystal plane (111) orientations and field copper of the substrate with a copper electroplating bath, wherein copper electroplated on the copper treated with the composition electroplates at a faster rate than copper electroplated on the field copper.

The present invention is directed to a composition consisting of water, a crystal plane (111) orientation enrichment compound, optionally a pH adjusting agent, optionally an oxidizing agent, and optionally a surfactant.

The present invention is also directed to a composition consisting of water, a crystal plane (111) orientation enrichment compound chosen from a quaternary amine, optionally a pH adjusting agent, optionally an oxidizing agent, and optionally a surfactant.

The present invention is further directed to a composition consisting of water, a crystal plane (111) orientation enrichment compound chosen from a quaternary ammonium compound having the formula:

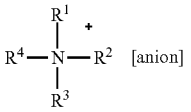

(I)

wherein $R^1$-$R^4$ are independently chosen from hydrogen, $C_1$-$C_5$ alkyl and benzyl, with the proviso that up to three of $R^1$-$R^4$ can be hydrogen at the same instance, optionally a pH adjusting agent, optionally an oxidizing agent, and optionally a surfactant.

The present invention enables enhanced copper electroplating such that copper electroplating rates can be tuned, such as increasing or even decreasing plating rates; copper can be selectively deposited on substrates without the use of photoresist or imaging tools; and copper morphology can be controlled. Additional advantages of the present invention are apparent to the person of ordinary skill in the art upon reading the disclosure and examples in the present specification.

DETAILED DESCRIPTION OF THE INVENTION

Figure 1:
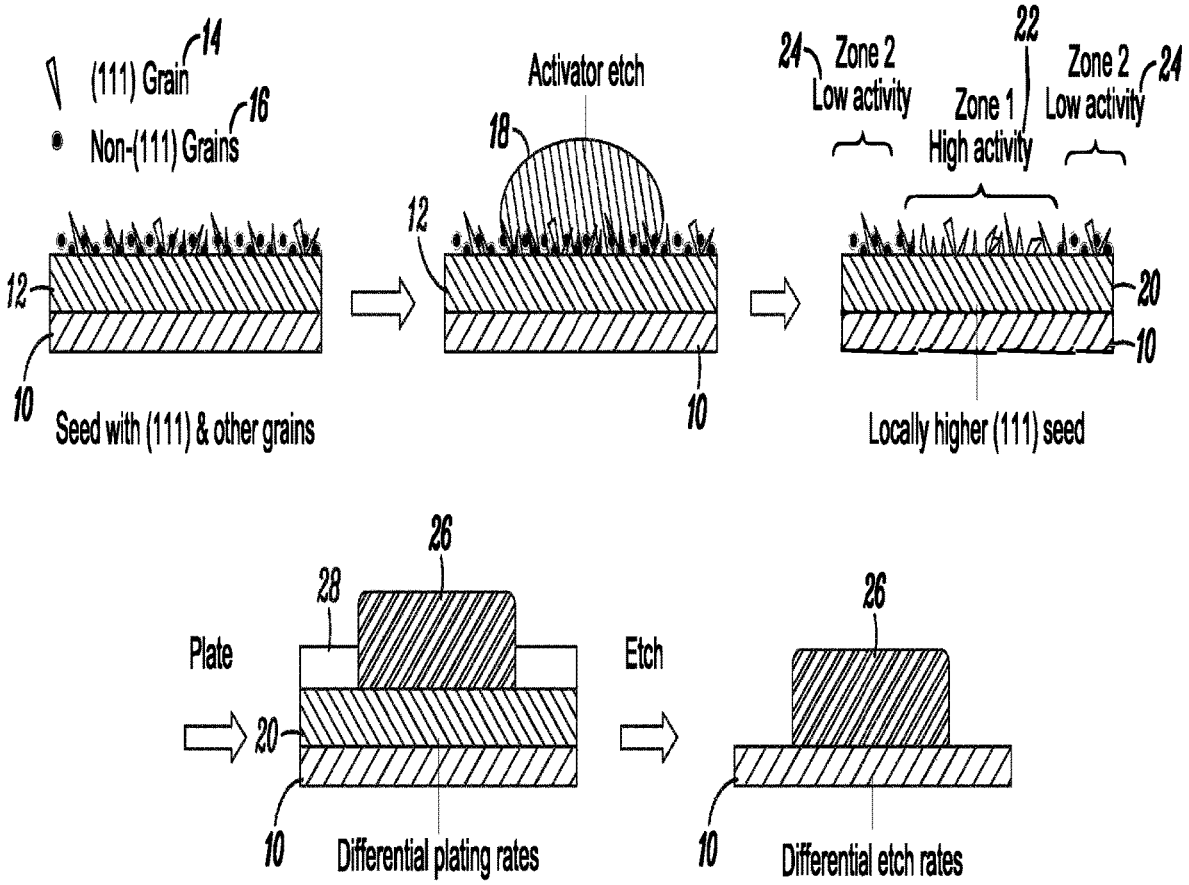
FIG. 1 is an illustration of copper seed patterning and circuit feature build-up by increasing exposure of copper grains having crystal plane (111) orientation by a method of the present invention followed by differential plating rates, then anisotropic etching away copper grains with non-(111) orientation and copper features plated on copper grains having crystal plane (111) orientation remaining on the substrate.

As used throughout this specification, the following abbreviations shall have the following meanings, unless the context clearly indicates otherwise: A=amperes; A/dm$^2$=amperes per square decimeter; ASD=A/dm$^2$; ° C.=degrees Centigrade; g=gram; mg=milligram; L=liter; mL=milliliter; μL=microliter; ppm=parts per million; ppb=parts per billion; M=moles/liter; mol=moles; nm=nanometers; μm=micron=micrometer; mm=millimeters; cm=centimeters; DI=deionized; XPS=X-Ray photoelectron spectroscopy; XRD=X-Ray diffraction spectroscopy; Hz=hertz; EBSD=electron backscatter spectroscopy; SEM=scanning electron micrograph; IPF=inverse pole coloring figure indicating crystal orientation on X, Y and Z axes; MUD=multiples of uniform density, such values are unitless; TMAH=tetramethylammonium hydroxide; NaOH=sodium hydroxide; $NH_4OH$=ammonium hydroxide; hydroxyl=$OH^-$; PEG=polyethylene glycol; min=minutes; sec=seconds; EO=ethylene oxide; PO=propylene oxide; HCl=hydrochloric acid; Cu=copper; PCB=printed circuit board; TSV=through silicon via; PDMS=polydimethylsiloxane; PR=photoresist; and N/A=not applicable.

As used throughout this specification, the term "bath" and "composition" are used interchangeably. "Deposition", "plating" and "electroplating" are used interchangeably throughout this specification. The expression "(hkl)" is a Miller Indices and defines a specific crystal plane in a lattice. The term "Miller Indices: (hkl) mean the orientation of a surface of a crystal plane defined by considering how the plane (or any parallel plane) intersects the main crystallographic axis of a solid (i.e., the reference coordinates—x, y, and z axis as defined in a crystal, wherein x=h, y=k and z=1), wherein a set of numbers (hkl) quantify the intercepts and are used to identify the plane. The term "plane" means a two-dimensional surface (having length and width) where a straight line joining any two points in the plane would wholly lie. The term "lattice" means an arrangement in space of isolated points in a regular pattern, showing the position of atoms, molecules or ions in a structure of a crystal. The term "exposed grain" means metal grains, such as copper metal grains, which are at a surface of a metal substrate and available for interaction with a metal plating composition such that the metal of the metal plating composition can deposit on the exposed metal grains of the metal substrate. The term "surface" means a section of a substrate in contact with the ambient environment. The term "field" or "field copper" means copper which is not treated with a crystal plane (111) orientation enrichment compound. The term "crystal plane (111) orientation enrichment compound" means a chemical compound which increases exposure of metal grains, such as copper metal grains, having crystal plane (111) orientations at the area where metal is contacted with the chemical compound. The term "aspect ratio" means ratio of the height of a feature compared to the width of the feature. The term "ppm" as used in the present specification is equivalent to mg/L. "Halide" refers to fluoride, chloride, bromide and iodide. Likewise, "halo" refers to fluoro, chloro, bromo and iodo. The term "alkyl" includes linear and branched $C_nH_{2n+1}$, wherein n is a number or integer. A "suppressor" refers to an organic additive that suppresses the plating rate of a metal during electroplating. The term "accelerator" means an organic compound that increases the plating rate of a metal, such compounds are often referred to as brighteners. The term "leveler" means an organic compound which enables a uniform metal deposit and can improve throwing power of an electroplating bath. The term "anisotropy" means directionally or locally dependent—different properties in different directions or portions of a material. The term "texture (crystalline)" means distribution of crystallographic orientations of a copper sample, wherein the sample is said to have no distinct texture when the distribution of these orientations is comparable to polycrystalline copper and, instead has some preferred orientation, then the sample has a weak, moderate or strong texture, wherein the degree is dependent on the percentage of crystals having the preferred orientation. The term "morphology" means the physical dimensions, such as height, length and width, and surface appearance of a feature. The term "predetermined time" means the time in which an event is performed or completed, such as in seconds, minutes or hours. The terms "composition", "solution" and "activator etch" are used interchangeably throughout the specification. The term "aperture" means opening and includes, but is not limited to, via, through-holes, trenches and through-silicon via. The articles "a" and "an" refer to the singular and the plural. All amounts in percent are by weight, unless otherwise noted. All numerical ranges are inclusive and combinable in any order, except where it is clear such numerical ranges are constrained to add up to 100%.

Compositions to increase exposed copper grains having a crystal plane (111) orientation or texture consist of water, a crystal plane (111) orientation enrichment compound, optionally a pH adjusting agent, optionally a source of metal ions, counter anions, optionally a rate increasing compound and optionally a surfactant. Crystal plane (111) orientation enrichment compounds of the present invention are compounds, preferably organic compounds, which increase the amount of exposed copper grains having crystal plane (111) orientation. More preferably, the crystal plane (111) orientation enrichment compounds of the present invention are quaternary amines, further preferably, the crystal plane (111) orientation enrichment compounds of the present invention are quaternary ammonium compound having the formula:

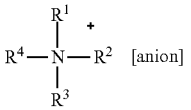

(I)

wherein $R^1$-$R^4$ are independently chosen from hydrogen, $C_1$-$C_5$ alkyl and benzyl, with the proviso that up to three of $R^1$-$R^4$ can be hydrogen at the same instance, preferably, $R^1$-$R^4$ are independently chosen from hydrogen $C_1$-$C_4$ alkyl and benzyl, with the proviso that up to three of $R^1$-$R^4$ can be hydrogen at the same instance, more preferably, $R^1$-$R^4$ are independently chosen from hydrogen, $C_1$-$C_3$ alky and benzyl, with the proviso that up to three of $R^1$-$R^4$ can be hydrogen at the same instance, further preferably, $R^1$-$R^4$ are independently chosen from hydrogen, $C_1$-$C_2$ alkyl and benzyl, with the proviso that up to three of $R^1$-$R^4$ can be hydrogen at the same instance, most preferably, $R^1$-$R^4$ are independently chosen from $C_1$-$C_2$ and benzyl with the proviso that only one of $R^1$-$R^4$ is benzyl.

Counter anions include, but are not limited to, hydroxyl, halides, such as chloride, bromide, iodide and fluoride, nitrate, carbonate, sulfate, phosphate and acetate, preferably, the counter anions are chosen from hydroxyl, chloride, nitrate and acetate, more preferably, the counter anions are chosen from hydroxyl, sulfate and chloride, most preferably, the counter anion is hydroxyl. Preferred quaternary ammonium compounds of the present invention include, but are not limited, to tetramethylammonium hydroxide, benzyltrimethyl ammonium hydroxide and triethylammonium hydroxide.

Crystal plane (111) orientation enrichment compounds of the present invention can be included in the compositions of the present invention in amounts of at least 0.01 M, preferably, from 0.01 M to 5 M, more preferably, from 0.1 M to 2 M, even more preferably, from 0.1 M to 1 M, further preferably, from 0.2 M to 1 M, most preferably, from 0.2 M to 0.5 M.

The compositions to increase exposed copper grains having a crystal plane (111) orientation are aqueous solutions. Preferably, in the compositions for increasing exposed copper grains having a crystal plane (111) orientation of the present invention, the water is at least one of deionized and distilled to limit incidental impurities.

Optionally, a pH adjusting agent can be included in the compositions to maintain a desired pH. One or more inorganic and organic acids can be included to adjust the pH of the compositions. Inorganic acids include, but are not limited to, sulfuric acid, hydrochloric acid, nitric acid and phosphoric acid. Organic acids include, but are not limited to, citric acid, acetic acid, alkane sulfonic acids, such a methane sulfonic acid. Bases which can be included in the compositions for increasing exposed copper grains having a crystal plane (111) orientation of the present invention to control pH include, but are not limited to, sodium hydroxide, potassium hydroxide, ammonium hydroxide and mixtures thereof.

The pH of the compositions for increasing exposed copper grains having a crystal plane (111) orientation of the present invention range from 0-14, preferably, from 1-14, more preferably from 3-14. When an alkaline pH of the compositions is desired, the pH preferably ranges from 8-14, more preferably, from 10-14, further preferably, from 12-14, and most preferably, from 13-14. When an acid pH is desired, the pH ranges preferably from 0-6, more preferably, from 1-5, most preferably from 2-5. An alkaline pH range is most preferred wherein the pH is from 12-14, most preferably, from 13-14.

In the compositions for increasing exposed copper grains having a crystal plane (111) orientation of the present invention, optionally, one or more oxidizing agents can be included. An oxidizing agent is a species with an oxidation potential that is lower than that of copper (0) or copper (I) at a given pH, such that electron transfer from copper (0) or copper (I) to the oxidizing agent occurs spontaneously. Oxidizing agents assist in enabling an increase in the rate of copper electroplating on the treated areas. Such oxidizing agents include, but are not limited to, compounds such as hydrogen peroxide ($H_2O_2$), monopersulfates, iodates, magnesium perphthalate, peracetic acid and other per-acids, persulfate, bromates, perbromate, periodate, halogens, hypochlorites, nitrates, nitric acid ($HNO_3$), benzoquinone and ferrocene, and derivatives of ferrocene.

Oxidizing agent of the compositions of the present invention also include metal ions from metal salts. Such metal ions include, but are not limited to, iron (III) from iron salts such as iron sulfate and iron trichloride, cerium (IV) from cerium salts such as cerium hydroxide, cerium sulfate, cerium nitrate, cerium ammonium nitrate and cerium chloride, manganese (IV), (VI) and (VII) from manganese salts such as potassium permanganate, silver (I) from silver salts such as from silver nitrate, copper (II) from copper salts such as copper sulfate pentahydrate and copper chloride, cobalt (III) from cobalt salts such as cobalt chloride, cobalt sulfate, cobalt nitrate, cobalt bromide and cobalt sulfate, nickel (II) and (IV) from nickel salts such as nickel chloride, nickel sulfate and nickel acetate, titanium (IV) from titanium salts such as titanium hydroxide, titanium chloride and titanium sulfate, vanadium (III), (IV) and (V) from vanadium salts such as sodium orthovanadate, vanadium carbonate, vanadium sulfate, vanadium phosphate and vanadium chloride, molybdenum (IV) from molybdenum salts such as molybdenum chlorate, molybdenum hypochlorite, molybdenum fluoride and molybdenum carbonate, gold (I) from gold salts such as gold chloride, palladium (II) from palladium salts such as palladium chloride and palladium acetate, platinum (II) from platinum salts such as platinum chloride, iridium (I) from iridium salts such as iridium chloride, germanium (II) from germanium salts such as germanium chloride, and bismuth (III) from bismuth salts such as bismuth chloride and bismuth oxide. When metal ions are included in the compositions of the present invention, the counter anions from the sources of the metal ions are also included in the compositions. Most preferably, the metal ions used as oxidizing agents are copper (II) salts such as copper (II) sulfate and iron (III) salts such as iron (III) chloride.

When optional oxidizing agents are included in the compositions of the present invention, they can be included in amounts of 1 ppm or greater, preferably, in amounts of 1 ppm to 10,000 ppm, more preferably, from 10 ppm to 1000 ppm. When the oxidizing agents are metal ions, the source of metal ions is included in sufficient amounts to, preferably, provide metal ions in amounts of 1 ppm or greater, preferably, 1 ppm to 100 ppm.

Optionally, one or more surfactants can be included in the compositions of the present invention. Such surfactants can include conventional surfactant well known to those of ordinary skill in the art. Such surfactants include non-ionic surfactants, cationic surfactants, anionic surfactants and amphoteric surfactants. For example, non-ionic surfactants can include, polyesters, polyethylene oxides, polypropylene oxides, alcohols, ethoxylates, silicon compounds, polyethers, glycosides and their derivatives; and anionic surfactants can include anionic carboxylates or organic sulfates such as sodium lauryl either sulfate (SLES).

Surfactants can be included in conventional amounts. Preferably, when surfactants are included in the compositions of the present invention they are included in amounts of 0.1 g/L to 10 g/L.

In the method of treating a copper substrate with the compositions of the present invention to increase exposed copper grains having crystal plane (111) orientations, the compositions of the present invention are applied to the copper substrate and allowed to remain on the copper for a sufficient amount of time to increase the amount of exposed copper grains having crystal plane (111) orientation. Preferably, the composition remains on the copper for at least 5 sec, more preferably, at least 30 sec, further preferably, at least 100 sec. The longer the time exposure the more grains having crystal plane (111) orientations are exposed. Optionally, after exposure time is complete, the copper can be rinsed with DI water. While not being bound by theory, application of the compositions of the present invention to a copper substrate etch away non-(111) orientation copper grains and non-crystalline grains to increase the amount of exposed copper grains having crystal plane (111) orientations.

The compositions of the present invention can be applied at temperatures from room temperature to 60° C., preferably, from room temperature to 30° C., more preferably the compositions are applied to copper at room temperature.

The copper substrates treated with the compositions of the present invention can be characterized for the percentage of surface area containing grains of crystal plane orientations or texture using conventional spectroscopic apparatus, such as EBSD spectroscopy. In the case of EBSD spectroscopy, the multiples of uniform density (MUD) value on the inverse pole figure (IPF) on the z axis is used to determine the overall increase in copper grains having crystal plane (111) orientations, wherein the expression (111) is a Miller Indices. The Miller Indices: (111) mean the orientation of a surface of a crystal plane defined by considering how the plane, or any parallel plane, intersects the main crystallographic axis of a solid, i.e., the reference coordinates—x, y, and z axis as defined in a crystal, wherein x=1, y=1 and z=1, wherein a set of numbers (111) quantify the intercepts and are used to identify the plane. Alternatively, the area of the IPF Z map corresponding to (111) oriented grains obtained via EBSD analysis can be calculated to determine the fraction of the exposed surface that corresponds to (111) grains rather than non-(111) grains. To differentiate areas of the copper to selectively plate at a faster rate in the treated area, the percentage of the surface area that is (111) grains increases by 5% or greater, preferably, 5%-80%, more preferably, increases to become 100% (111), versus the non-treated copper. Alternatively, a bulk measurement can be performed on the treated copper, and the degree of activation can be measured by the ratio of the area under the (111) peak over the area under the (200) or (220) peaks. As the activation degree increases, this ratio also increases. Alternatively, the areas under the (111), (200), and (220) can be converted to % content of each grain. To differentiate areas of the copper to selectively plate at a faster rate in the treated area, the percentage of the deposit that is (111) grains increases at least by 2%, preferably, 2%-10%, more preferably, 100%, versus the non-treated copper.

The compositions of the present invention can be applied by immersing a substrate with a copper layer in the composition, by spraying the composition on the copper of the substrate, spin-coating, or other conventional method for applying solutions to a substrate. The compositions of the present invention can also be selectively applied to copper. Selective application can be done by any conventional method for selectively applying solutions to a substrate. Such selective applications include, but are not limited to ink jet application, writing pens, eye droppers, polymer stamps having patterned surfaces, masks such as by imaged photoresist or screen printing. Selective application can also be achieved by exploiting wetting patterns on an "activator puddle" or while applying the composition of the present invention in a spin coater, such that areas that are wetted differently will undergo a different degree of activation. Preferably, the compositions of the present invention are selectively applied to copper on a substrate, more preferably, selective application is by ink jet, writing pen, eye dropper or polymer stamp.

The composition which increases exposed copper grains having the crystal plane (111) orientation can be used to treat copper surfaces on many conventional substrates such as printed circuit boards and dielectric or semiconductor wafers with seed layers, such as copper seed layers, which enable electrical conductivity of the dielectric wafers. Such dielectric wafers include, but are not limited to, silicon wafers such as monocrystalline, polycrystalline and amorphous silicon, plastics such as Ajinomoto build-up film (ABF), acrylonitrile butadiene styrene (ABS), epoxides, polyimines, polyethylene terephthalate (PET), silica or alumina filled resins.

After application of the composition which increases the exposed copper grains having crystal plane (111) orientation by the method of the present invention, the copper of the substrate can be electroplated with additional copper to form additional copper layers or copper features, such as electrical circuitry, pillars, bond pads and line space features. The compositions and methods of the present invention can also be used to treat through-holes, vias and TSVs prior to filling these features by copper electroplating.

Selective application of the compositions of the present invention enables selective copper electroplating on the sections of the copper substrate treated with the compositions of the present invention. Sections of the treated copper substrate have increased exposed copper grains having crystal plane (111) orientations and copper plate at a faster rate than the sections of the copper substrate not treated with the compositions of the present invention. Copper features such as electrical circuitry, pillars, bond pads and line space features as well as other raised features of PCBs and dielectric wafers can be plated without using patterned masks, photo-tools or imaged photoresists to define the features.

FIG. 1 illustrates a method of the present invention. A silicon wafer substrate 10 includes a polycrystalline copper seed layer 12. The copper seed layer 12 includes a mixture of crystal plane (111) orientation copper grains 14 and non-(111) copper grains 16 having crystal plane orientations greater than (111), such as crystal plane (200) or (220) orientation and greater, or such as non-crystalline material. The composition of the present invention or activator etch 18 is selectively applied to the copper seed layer. After a predetermined time, the activator etch 18 on the treated copper seed layer is removed or washed away with DI water. The copper seed layer 12 becomes locally differentiated copper seed 20. Zone 1 22 which was treated with the activator etch 18 now has an increased amount of exposed crystal plane (111) orientation copper grains increased relative to the untreated surface 12. Zone 1 now has a higher activity for copper electroplating over Zone 2 24 where a smaller fraction of the surface is covered by (111) orientation copper grains as compared to Zone 1 22.

The locally differentiated copper seed layer can then be electroplated with copper using a copper electroplating bath and conventional electroplating parameters. Copper plating in Zone 1 22 plates at a faster rate than copper plating in Zone 2 24 such that copper plated in Zone 1 enables copper features 26 which are taller or more prominent than the copper plated 28 in Zone 2 over the same predetermined time. Optionally, the plated copper can be etched. Etching is selective as illustrated in FIG. 1 and anisotropic. The copper electroplated in Zone 1 22, which grows on the seed treated with the composition of the present invention and where the crystal plane (111) orientation is more predominant, etches at a slower rate than the copper plated in Zone 2. As shown in FIG. 1, the etch removes all the copper plated in Zone 2, including the copper seed. After etching, the copper features 26 plated in Zone 1 remain with the rest of the silicon wafer substrate 10 clear of copper.

Etch solutions include, but are not limited to, aqueous sodium persulfate solutions, hydrogen peroxide solution, ammonium peroxide mixtures, nitric acid solutions, and ferric chloride solutions, all of which can also contain pH adjusting agents and oxidizing agents such as copper (II) ions.

The method of the present invention further enables copper electroplating features over a variety of aspect ratios such that the feature morphology and plated deposit height is substantially the same even though the aspect ratio varies. For example, copper electroplated on substrates containing copper seed layers treated with a composition of the present invention with aspect ratios ranging from 4:1 to 1:1000 over the same predetermined time plate features having substantially the same height. The increase in crystal plane (111) orientation enables copper plating features having substantially the same morphology over a wide range of aspect ratios.

Figure 2:
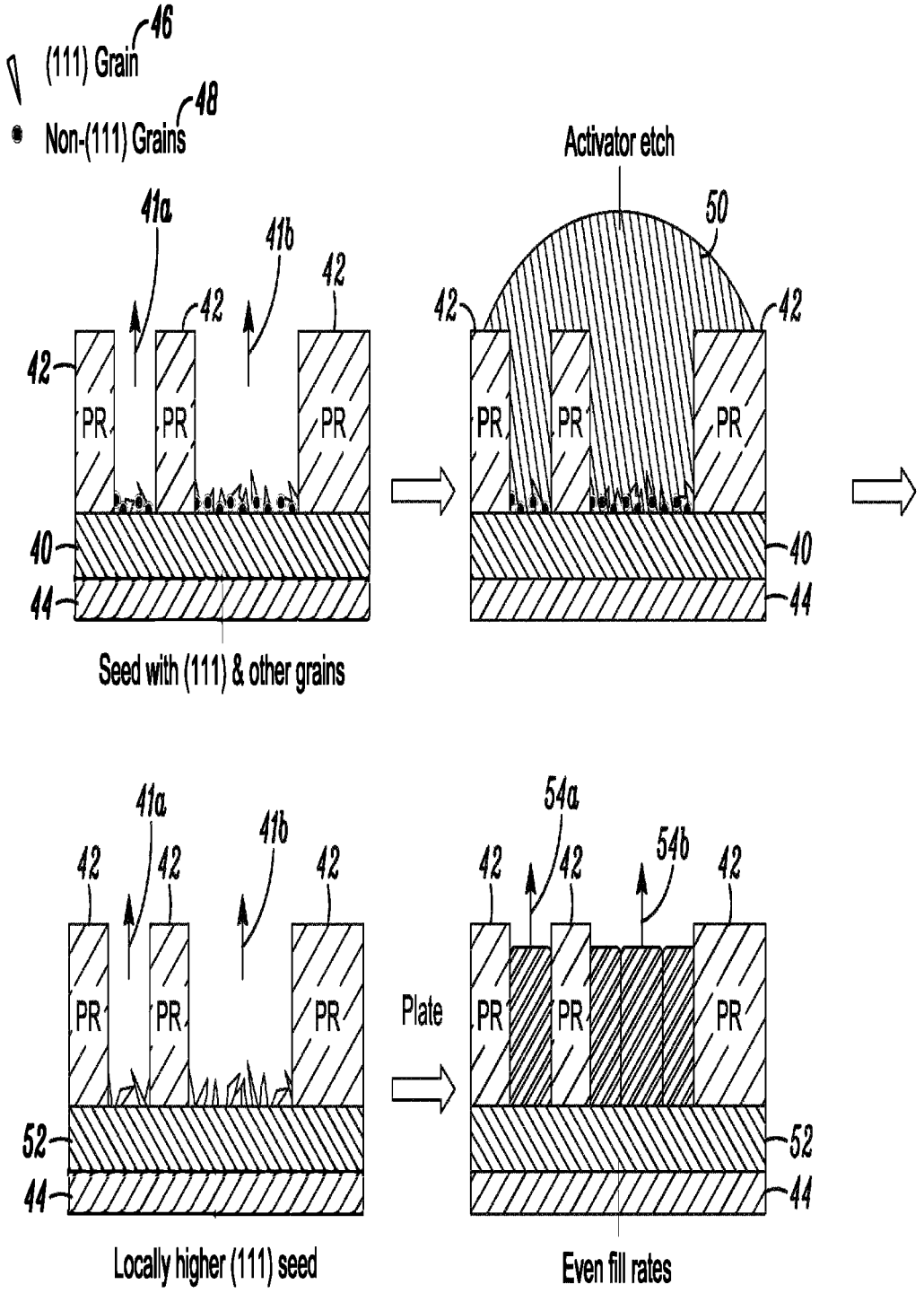
FIG. 2 is an illustration of increasing exposure of copper grains having crystal plane (111) orientation by a method of the present invention within photoresist defined features of different aspect ratios but with the plating fill rates the same.

FIG. 2 illustrates the present invention where the activator solution is applied on a conductive polycrystalline copper seed layer 40 through a pattern of imaged photoresist 42 with apertures having different aspect ratios. The photoresist defines apertures 41A and 41B of different aspect ratios. A silicon wafer substrate 44 includes the polycrystalline copper seed layer 40. The polycrystalline copper seed layer 40 includes a mixture of crystal plane (111) orientation copper grains 46 and non-(111) copper grains 48 having crystal plane orientations greater than (111), such as crystal plane (200) or (220) orientation and greater, or such as non-crystalline material. The composition of the present invention or activator etch 50 is selectively applied to the polycrystalline copper seed layer 40. After a predetermined time, the activator etch 50 on the treated polycrystalline copper seed layer is removed or washed away with DI water. The polycrystalline copper seed layer 40 becomes locally differentiated copper seed 52. The locally differentiated copper seed treated with the activator etch 50 now has an increased amount of exposed crystal plane (111) orientation copper grains compared to polycrystalline copper seed layer 40.

The locally differentiated copper seed 52 at the bottom of the apertures 41A and 41B can then be electroplated with copper to fill the apertures using a conventional copper electroplating bath and conventional electroplating parameters. Although the aspect ratios of the two apertures are different, copper features 54A and 54B are plated in the apertures at substantially the same plating rate. The photoresist which defines the features is stripped away after plating using conventional photoresist strippers well known to those of ordinary skill in the art.

Copper electroplating baths which can be used in the method of the present invention contain a source of copper ions. Copper ion sources are copper salts and include but are not limited to, copper sulfate; copper halides such as copper chloride; copper acetate; copper nitrate; copper fluoroborate; copper alkylsulfonates; copper arylsulfonates; copper sulfamate; and copper gluconate. Exemplary copper alkylsulfonates include copper ($C_1$-$C_6$)alkylsulfonate and copper ($C_1$-$C_3$)alkylsulfonate. Preferably, copper alkylsulfonates are copper methanesulfonate, copper ethanesulfonate and copper propanesulfonate. Exemplary copper arylsulfonates include, but are not limited to copper phenyl sulfonate, copper phenol sulfonate and copper p-toluene sulfonate. Mixtures of copper ion sources can be used.

The copper salts can be used in the aqueous electroplating baths in amounts that provide sufficient copper ion concentrations for electroplating copper on a substrate. Preferably, the copper salt is present in an amount sufficient to provide an amount of copper ions of 10 g/L to 180 g/L of plating solution, more preferably, from 20 g/L to 100 g/L.

Acids can be included in the copper electroplating baths. Acids include, but are not limited to, sulfuric acid, fluoroboric acid, alkanesulfonic acids such as methanesulfonic acid, ethanesulfonic acid, propanesulfonic acid and trifluoromethane sulfonic acid, arylsulfonic acids such as phenyl sulfonic acid, phenol sulfonic acid and toluene sulfonic acid, sulfamic acid, hydrochloric acid, and phosphoric acid. Mixtures of acids can be used in the copper electroplating baths. Preferably, acids include sulfuric acid, methanesulfonic acid, ethanesulfonic acid, propanesulfonic acid, and mixtures thereof.

Acids are preferably present in amounts of 1 g/L to 300 g/L, more preferably, from 5 g/L to 250 g/L, further preferably, from 10 to 150 g/L. Acids are generally commercially available from a variety of sources and can be used without further purification.

A source of halide ions can be included in the copper electroplating baths. Halide ions are preferably chloride ions. A preferred source of chloride ions is hydrogen chloride. Chloride ion concentrations are in amounts of 1 ppm to 100 ppm, more preferably, from 10 to 100 ppm, further preferably, from 20 to 75 ppm.

Accelerators include, but are not limited to, 3-mercaptopropylsulfonic acid and its sodium salt, 2-mercapto-ethanesulfonic acid and its sodium salt, and bissulfopropyl disulfide and its sodium salt, 3-(benzthiazoyl-2-thio)-propylsulfonic acid sodium salt, 3-mercaptopropane-1-sulfonic acid sodium salt, ethylenedithiodipropylsulfonic acid sodium salt, bis-(p-sulfophenyl)-disulfide disodium salt, bis-(ω-sulfobutyl)-disulfide disodium salt, bis-(ω-sulfohydroxypropyl)-disulfide disodium salt, bis-(ω-sulfopropyl)-disulfide disodium salt, bis-(ω-sulfopropyl)-sulfide disodium salt, methyl-(ω-sulfopropyl)-disulfide sodium salt, methyl-(ω-sulfopropyl)-trisulfide disodium salt, O-ethyl-dithiocarbonic acid-S-(ω-sulfopropyl)-ester, potassium salt thioglycoli acid, thiophosphoric acid-O-ethyl-bis-(ω-sulfpropyl)-ester disodium salt, thiophosphoric, acid-tris(co-sulfopropyl)-ester trisodium salt, N,N-dimethyldithiocarbamic acid (3-sulfopropyl) ester, sodium salt, (O-ethyldithiocarbonato)-S-(3-sulfopropyl)-ester, potassium salt, 3-[(amino-iminomethyl)-thio]-1-propanesulfonic acid and 3-(2-benzthiazolylthio)-1-propanesulfonic acid, sodium salt. Preferably the accelerator is bissulfopropyl disulfide or its sodium salt. Preferably, accelerators are included in copper electroplating baths in amounts of 1 ppb to 500 ppm, more preferably from 50 ppb to 50 ppm.

Conventional suppressors can be included in the copper electroplating baths. Suppressors include, but are not limited to polyethylene glycol, polypropylene glycol, polypropylene glycol copolymers and polyethylene glycol copolymers, including ethylene oxide-propylene oxide ("EO/PO") copolymers and butyl alcohol-ethylene oxide-propylene oxide copolymers. Preferred suppressors are EO/PO block copolymers with weight average molecular weights of 500 to 10,000 g/mol, more preferably, from 1000 to 10,000 g/mol. Even further preferred are EO/PO random copolymers with weight average molecular weights of 500 to 10,000 g/mol, more preferably, from 1000 to 10,000 g/mol. Even further preferred are polyethylene glycol polymers with weight average molecular weights of 500 to 10,000 g/mol, more preferably, from 1000 to 10,000 g/mol.

Even further preferred are surfactants having the general formula:

(II)

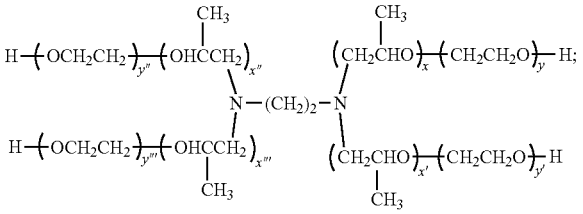

with weight average molecular weights of 1000-10,000 g/mol and commercially available from BASF, Mount Olive, N.J. as TECTRONIC® surfactants; and (III)

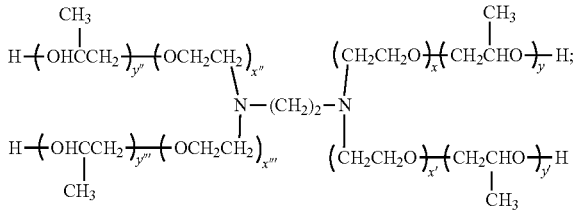

with weight average molecular weight of 1000-10,000 g/mol and commercially available from BASF as TECTRONIC® R surfactants, wherein the variables x, x', x'', x''', y, y', y'' and y''' are integers equal to or greater than 1 such that the weight average molecular weights of the copolymers range from 1000-10,000 g/mol.

Suppressors are preferably included in the copper electroplating baths in amounts of 0.5 g/L to 20 g/L, more preferably, from 1 g/L to 10 g/L, further preferably, from. 1 g/L to 5 g/L.

Optionally, one or more levelers can be included in the copper electroplating baths. Levelers can be polymeric or non-polymeric. Polymeric levelers include, but are not limited to, polyethylenimine, polyamidoamines, polyallylamines, and reaction products of a nitrogen base with an epoxide. Such nitrogen bases can be primary, secondary, tertiary, or quaternary alkyl amines, aryl amines or heterocyclic amines and their quaternized derivatives such as alkylated aryl or heterocyclic amines. Exemplary nitrogen bases include, but are not limited to, dialkylamines, trialkylamines, arylalkylamines, diarylamines. imidazole, triazole, tetrazole, benzimidazole, benzotriazole, piperidine, morpholine, piperazine, pyridine, oxazole, benzoxazole, pyrimidine, quinoline, and isoquinoline, which may all be used as free bases or as quaternized nitrogen bases. An epoxy group-containing compound can react with the nitrogen base to form a copolymer. Such epoxides include, but are not limited to, epihalohydrin such as epichlorohydrin and epibromohydrin, monoepoxide compounds and polyepoxide compounds.

Derivatives of polyethylenimines and polyamidoamines can also be used as levelers. Such derivatives include, but are not limited to, reaction products of a polyethylenimine with an epoxide and reaction products of a polyamidoamine with an epoxide.

Examples of suitable reaction products of amines with epoxides are those disclosed in U.S. Pat. Nos. 3,320,317; 4,038,161; 4,336,114; and 6,610,192. The preparation of the reaction products of certain amines and certain epoxides are well known, see, e.g., U.S. Pat. No. 3,320,317.

Epoxide-containing compounds can be obtained from a variety of commercial sources, such as Sigma-Aldrich, or can be prepared using a variety methods disclosed in the literature or known in the art.

In general, levelers can be prepared by reacting one or more benzimidazole compounds with one or more epoxy compounds. In general, a desired amount of the benzimidazole and epoxy compounds are added into the reaction flask, followed by addition of water. The resulting mixture is heated to approximately to 75-95° C. for 4 to 6 hours. After an additional 6-12 hours of stirring at room temperature, the resulting reaction product is diluted with water. The reaction product may be used as-is in aqueous solution, or can be purified.

Preferably, leveling agents have a weight average molecular weight (Mw) of 1000 g/mol to 50,000 g/mol.

Non-polymeric leveling agents include, but are not limited to, non-polymeric sulfur-containing and non-polymeric nitrogen-containing compounds. Exemplary sulfur-containing leveling compounds include thiourea and substituted thioureas. Exemplary nitrogen-containing compounds include primary, secondary, tertiary and quaternary nitrogen bases. Such nitrogen bases may be alkyl amines, aryl amines, and cyclic amines (i.e. cyclic compounds having a nitrogen as a member of the ring). Suitable nitrogen bases include, but are not limited to, dialkylamines, trialkylamines, arylalkylamines, diarylamines, imidazole, triazole, tetrazole, benzimidazole, benzotriazole, piperidine, morpholine, piperazine, pyridine, oxazole, benzoxazole, pyrimidine, quonoline, and isoquinoline.

Levelers are preferably included in the copper electroplating baths in amounts of 0.01 ppm to 100 ppm, more preferably, from 0.01 ppm to 10 ppm, further preferably, from 0.01 ppm to 1 ppm.

The temperature of the copper electroplating baths during electroplating range, preferably, from room temperature to 65° C., more preferably, from room temperature to 35° C., further preferably, from room temperature to 30° C.

A substrate can be electroplated with copper by contacting the substrate with the plating bath. The substrate functions as the cathode. The anode can be a soluble or insoluble anode. Sufficient current density is applied and plating is performed for a time to deposit copper having a desired thickness and morphology on the substrate. Current densities can range from 0.5 ASD to 30 ASD, preferably from, 0.5 ASD to 20 ASD, more preferably from 1 ASD to 10 ASD, further preferably from 1 ASD to 5 ASD.

In the method of the present invention, copper electroplating baths can be designed to further enhance copper electroplating and copper electroplated features on the area of the substrates treated with the compositions of the present invention which increase exposed copper grains with crystal plane (111) orientation. Organic additives, such as, but not limited to, suppressors, accelerators and levelers can be added to the copper electroplating baths to enable further enhancement and copper electroplating bath performance in combination with the treatment of copper substrates with the compositions of the present invention which increase exposed copper grains having crystal plane (111) orientation. Preferred organic additives, which include suppressors, assist in increasing the plating rate in the areas of coper treated with the compositions of the present invention versus the non-treated areas when used in combination with a plating accelerator in the plating bath. Preferred suppressors include, but are not limited to, the compounds of formulae (II) and (III) above having Mw ranging from 1000 g/mol to 10,000 g/mol, and polyethylene glycols with Mw of 1000 g/mol to 10,000 g/mol.

The accelerators and the levelers in the copper electroplating baths can be varied with the remainder of the copper electroplating bath components remaining constant including the concentration of the components, such that the copper plating rate in combination with the treatment compositions of the present invention which increase exposure of copper grains having crystal plane (111) orientation is further increased. Overall, the plating rate is further increased when a ratio of the concertation of the accelerator to the concentration of the leveler in the bath is higher. Preferred copper electroplating baths include accelerator to leveler concentration ratios of at least 5:1. Further preferred copper electroplating baths include accelerator to leveler concentration ratios of 5:1 to 2000:1. Even more preferred copper electroplating baths include accelerator to leveler concentration ratios of 20:1 to 2000:1. Most preferred copper electroplating baths include accelerator to leveler concentration ratios of 200:1 to 2000:1.

While the present invention is described using copper electroplating baths to plate copper on sections treated with the compositions of the present invention which increase exposed copper grains having crystal plane (111) orientation, it is envisioned that the treated sections can also be plated with copper alloys and achieve desired plating rates and feature morphology. Copper alloys include, but are not limited to, copper-tin, copper-nickel, copper-zinc, copper-bismuth and copper-silver. Such copper alloy baths are commercially available or described in the literature.

The following examples are included to further illustrate the invention but are not intended to limit its scope.

Example 1

Modifying Exposed Copper Grain Orientation with TMAH

A plurality of silicon wafers with 180 nm thick copper seed layers obtained from WRS Materials (Vancouver, Wash.) were analyzed for their surface crystal plane (111) orientation using a Field Emission-SEM (FEI model Helios G3) coupled with EBSD detector (EDAX Inc., model Hikari Super and data was analyzed by OIM™ Analysis software). The prevalence of surface crystal plane (111) orientation grains on the copper seed was determined through the maximum in the IPF on the Z axis, represented by the Multiples of Uniform Density (MUD) value. The IPF data was collected on a 20 by 20 μm area of the seed surface using a 50 nm pixel pitch and a 50 Hz scan rate, which provided a hit rate higher than 50% in all samples. The higher the MUD value for the IPF on the Z axis, the more prevalent the crystal plane (111) orientation grains were on the surface of the copper seed layers. In addition, the copper seeds were analyzed via XRD spectroscopy, specifically by comparing the area under the diffraction peaks corresponding to (111) and (200) orientation in the diffraction intensity versus 2θ diffraction angle using Jade 2010 MDI software from KSA Analytical Systems, Aubrey, Tex.

The copper seed layers, prior to application of the aqueous 0.25M TMAH solution, pH=14, had a MUD value of 4.96 in the EBSD IPF on the Z axis and a bulk (111)/(200) ratio of 9:1 from the XRD diffraction pattern. 10 μL of an aqueous 0.25M TMAH solution were applied at room temperature onto the same copper seed layers. The solution was left to act upon the seed layers for 1 hour or 5 hours at room temperature. The copper seed layers were then rinsed with DI water and the exposed grain orientations on the treated copper seed layers were again characterized by EBSD and XRD spectroscopies Results showed that the application of the solution increased the overall crystal plane (111) orientation of the copper seed layers significantly, such that the maximum in the MUD value on the IPF on the Z axis for the crystal plane (111) orientation increased from 4.96 to 11.68 with 1 hour TMAH exposure to 14.69 with 5 hours of TMAH exposure. At the same time, the (111)/(200) peak area ratio in the seed bulk XRD pattern increased from (9:1) to (15:1) with 1 hour TMAH exposure to (24:1) with 5 hours of TMAH exposure treatment of the copper seed layers with the aqueous 0.25M TMAH solution enabled an increase in the crystal plane (111) orientation of the exposed copper grains. This resulted from the selective removal of non-(111) and non-crystalline material.

Example 2

Electroplating Copper on TMAH Treated Copper Seed Layers

Three (3) areas of a 180 nm thick copper seed layers on 1 cm by 2 cm silicon wafers were treated with an aqueous 0.25M TMAH solution having a pH=14. The three separate treated areas had diameters of 3.5 mm, 4.5 mm and 6 mm, as determined with a Keyence optical profilometer. The diameters of the treated areas were varied by increasing the volume of the TMAH solution applied from 6 μL to 10 μL to 20 μL. The solution was left to act on the copper seed layers for 2 min at room temperature. The copper seed layers were then rinsed with DI water and dried under a stream of air. The copper seed layers were then electroplated with the copper electroplating bath of Table 1 below to a target field height of 6 μm plating at 2 ASD and a temperature of 25° C. The pH of the copper electroplating bath was <1.

TABLE 1

| Component | Amount |
|---|---|
| Copper (II) ions from copper sulfate pentahydrate | 50 g/L |
| Sulfuric acid (98 wt %) | 100 g/L |
| Chloride ions from HCl | 50 ppm |
| Bis-sodium sulfopropyl disulfide | 40 ppm |
| EO/PO random copolymer with hydroxyl terminal groups (Mw = 1100) | 2 g/L |
| Butyldiglycidyl/imidazole/phenylimidazole copolymer (Mw = 9200) | 1 ppm |

The height of the features versus the inactivated field that resulted from copper electroplating on the seed layers were then measured with a Keyence optical profilometer. It was found that the features retained the same diameter as the contact area of the treatment solution (3.5 mm, 4.5 mm and 6 mm). The feature heights on the solution treated areas ranged from 4-6 μm for all features, regardless of the aspect ratio. The field heights were measured to be 4 μm, indicating that the activated areas plated faster than the untreated fields.

Example 3

Electroplating Copper on TMAH Treated Copper Seed Layers and Etch Rate

Figure 3:
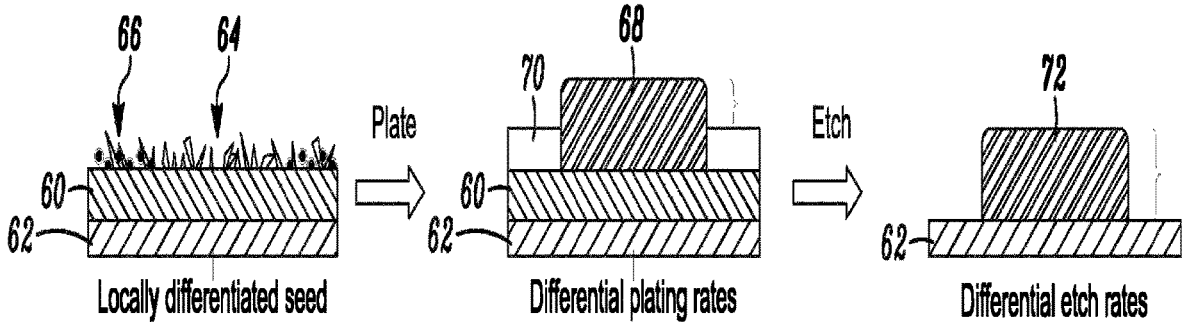
FIG. 3 is another illustration of copper seed patterning and circuit feature build-up by increasing exposure of copper grains having crystal plane (111) orientation by a method of the present invention followed by differential plating, then anisotropic etching away of field copper or electroplated copper plated on areas with lower exposure of (111) grains.

10 μL aliquots of an aqueous 0.25M TMAH solution having a pH=14 with 4.2 mm diameters were applied onto a 180 nm thick copper seed layer 60 on a silicon wafer 62 as shown in FIG. 3. The solution acted on the copper seed layer surface for 2 min to increase the exposed copper grains having crystal plane (111) orientations 64 over the non-(111) copper grains and non-crystalline material 66. The copper seed layer was then rinsed with DI water and dried under a stream of air. The seed layer was then electroplated with the copper electroplating bath of Table 1 of Example 2 above to a target field height of 6 μm plating at 2 ASD. The height of the features that resulted from the treated areas versus the untreated field were then measured with a Keyence optical profilometer as in Example 2. The features retained the same 4.2 mm diameters as the contact area of the solution. The features were measured as 5.99 μm, 6.63 μm and 6.25 μm 68 from the top of the field copper. The height of electroplated field copper 70 on the non-treated copper seed layer was determined to be about 6 μm thick.

The entire surface of the copper electroplated seed layer was then treated with a copper etch solution containing 100 g/L sodium persulfate, 2% sulfuric acid and 1 g/L copper (II) ions as copper sulfate pentahydrate. The entire copper deposits, seed layer as well as electroplated copper, was etched until the field copper 70 and copper seed layer 60 was removed. The feature heights 72 from the silicon wafer was measured with the optical profilometer. It was found that the feature heights 72 were now 8.89 μm, 9.18 μm and 9.22 μm indicating an etch rate anisotropy where the copper plated on the solution treated areas exhibited a slower etch rate than the copper plated on the non-treated areas.

This etch rate anisotropy can be advantageously exploited to further increase feature height. This also demonstrated that patterning by exposed copper grains having crystal plane (111) orientation control can be used to not only control plating rates, but also properties of the copper plated deposits that are related to its grain structure and crystallinity.

Examples 4-12

Control of Feature Height by TMAH Solution pH and Contact Time

10 μL aliquots of 0.25M TMAH solutions were applied onto 180 nm copper seeds on silicon wafers. The 0.25M TMAH solutions varied in pH of 14, 5, and 3 by addition of sulfuric acid from a 10% sulfuric acid stock solution in water. The contact times were 60 sec, 300 sec, and 1800 sec. The copper seeds were then rinsed with DI water and plated with the copper electroplating bath in Table 2 to a target field thickness of 6 μm. Plating was done at 25° C. and at a current density of 2 ASD.

TABLE 2

| Component | Amount |
|---|---|
| Copper (II) ions from copper sulfate pentahydrate | 50 g/L |
| Sulfuric acid (98 wt %) | 100 g/L |
| Chloride ions from HCl | 50 ppm |
| Bis-sodium sulfopropyl disulfide | 20 ppm |
| TECTRONIC ™ surfactant of diamine core-EO/PO block copolymer (Mw = 7000) | 2 g/L |
| Butyldiglycidyl/imidazole/phenylimidazole copolymer (Mw = 9200) | 0.1 ppm |

The plated heights of the plated features above the field height were then measured with an optical profilometer. The height variations are listed in Table 3. The data showed that the increased plating rate in the activated area was maximized when the TMAH solution was contacted for longer periods of time, when the pH was basic, or more than mildly acidic (i.e. <4).

TABLE 3

| Examples | Exposure Time (sec) | pH = 14 Feature Height (μm) | pH = 5 Feature Height (μm) | pH = 3 Feature Height (μm) |
|---|---|---|---|---|
| 4-6 | 60 | 3.718 | 0.334 | 1.42 |
| 7-9 | 300 | 11.41 | 0.437 | 5.135 |
| 10-12 | 1800 | 12.299 | 1.531 | 6.582 |

Examples 13-24

Control of Feature Height by TMAH Solution Contact Time Using a Stamp

A PDMS stamp containing a pattern of circuit features was soaked in 0.25M TMAH solution for 1 minute. The stamp was then applied onto 180 nm copper seed layers on silicon wafers. The solution was transferred from the stamp to the copper seed layers reproducing the pattern of circuit features on the copper seed layers. The contact time was varied at 60 sec, 14400 sec, and 72000 sec. The copper seed layers were then rinsed with DI water, air-dried, and plated with the copper electroplating bath disclosed in Table 2 in Examples 4-12 above. The process was repeated for 4 different samples. The data disclosed in Table 4 showed that for a given solution application time, the heights of the copper plated features were substantially the same. In addition, the longer the solution was in contact with the copper seed layers, the higher the copper plated features were on the seed layers.

TABLE 4

| Examples | Exposure Time (sec) | Run 1 Feature Height (μm) | Run 2 Feature Height (μm) | Run 3 Feature Height (μm) | Run 4 Feature Height (μm) |
|---|---|---|---|---|---|
| 13-16 | 60 | 3.496 | 4.151 | 3.917 | 3.905 |
| 17-20 | 14400 | 5.657 | 6.697 | 6.08 | 5.932 |
| 21-24 | 72000 | 12.072 | 12.527 | 11.324 | 13.147 |

Example 25-29

Impact of Ammonium Ion

10 μL aliquots of 0.25 M solutions of different ammonium hydroxides were placed onto 180 nm copper seed layers on silicon wafers for 2 min. The pH of the solutions was around 14. As a comparative example, the surface activation capability of 0.25 M NaOH was also examined. The copper surfaces were then processed in the same manner as Examples 4-12. The heights above the field of the plated features are summarized in Table 5. TMAH was observed to have the largest impact on copper seed activation, whereas NaOH or $NH_4OH$ showed minimal surface activation.

TABLE 5

| Example | Ammonium Compound | Feature Height (μm) |
|---|---|---|
| 25 | TMAH | 6.625 |
| 26 | Trimethyl-benzyl ammonium hydroxide | 3.066 |
| 27 | Triethyl ammonium hydroxide | 3.800 |
| 28 | NaOH | 0.463 |
| 29 | $NH_4OH$ | 0.538 |

Example 30-34

Increasing Electroplating Speed in Activated Areas

10 μL aliquots of 0.25M TMAH solution with varying amounts of dissolved copper (II) ions from copper sulfate pentahydrate at pH=14 or pH=5 were selectively applied onto a 180 nm copper seed layers on silicon wafers. A pH=5 was achieved by adding sufficient sulfuric acid from a 10% sulfuric acid stock solution. The contact times were 1800 sec. The copper was then processed in the in the same manner as Examples 4-12. The feature height variations are listed in Table 6. The data showed that including copper (II) ions, a secondary oxidizer, in a 0.25M TMAH solution can increase plating speed at an acid pH=5.

TABLE 6

| Copper (II) Ions (ppm) | pH = 14 | pH = 5 |
|---|---|---|
| 0 | 12.299 | 1.531 |
| 10 | 12.641 | 4.031 |
| 100 | N/A | 13.985 |

Examples 35-39

Controlling Feature Height Based on Trimethylbenzyl Ammonium Hydroxide Concentration 10 μL drops of trimethylbenyl ammonium hydroxide solutions with varying concentrations were applied onto a 180 nm copper seed layer on silicon wafers. The trimethylbenyl ammonium hydroxide concentration varied from 0 to 2.4 M. The pH of the solution which excluded the alkylammonium hydroxide had a pH=7. The pH of the trimethyl benzyl ammonium hydroxide solutions containing 0.25M to 2.5M concentrations ranged from 13.5 to 14. The contact times were 2 min. The copper surfaces were then processed in the same manner as Examples 4-12. The feature height variations are listed in Table 7. The data showed that the trimethylbenyl ammonium hydroxide concentrations can be used to control plated feature height.

TABLE 7

| Examples | Trimethylbenzyl Ammonium Hydroxide Concentration (M) | Feature Height (μm) |
|---|---|---|
| 35 | 0 | 0 |
| 36 | 0.25 | 3.066 |
| 37 | 0.6 | 5.247 |
| 38 | 1.2 | 5.734 |
| 39 | 2.4 | 16.681 |

Examples 40-44

Modifying Suppressor Type to Control Plated Feature Height

A plurality of copper electroplating baths was prepared having the components and amounts disclosed in Table 8. The only variable component of the baths was the type of suppressor. Suppressors were added in amounts of 2 g/L. One bath excluded the suppressor.

TABLE 8

| Component | Amount |
|---|---|
| Copper (II) ions from copper sulfate pentahydrate | 50 g/L |
| Sulfuric acid (98 wt %) | 100 g/L |
| Chloride ions from HCl | 50 ppm |
| Bis-sodium sulfopropyl disulfide | 20 ppm |
| Variable Suppressor | 2 g/L |
| Butyldiglycidyl/imidazole/phenylimidazole copolymer (Mw = 9200) | 0.1 ppm |

10 μL aliquots of an aqueous 0.25M TMAH solution with 4.2 mm diameters were applied onto a 180 nm thick copper seed layers on silicon wafers. The solutions acted on the copper seed layer surfaces for 1800 sec. The copper seed layers were then rinsed with DI water and dried under a stream of air. The seed layers were then electroplated with one of the copper electroplating baths of Table 8. Copper electroplating was done to achieve a target thickness of 6 μm. Copper electroplating was done at 25° C. at a current density of 2 ASD. The feature heights of the deposit plated on the activated areas versus the non-activated plated field were measured with an optical profilometer. The results are in Table 9.

TABLE 9

| Example | Suppressor | Feature Height (μm) |
|---|---|---|
| 40 | TECTRONIC ™ Surfactant | 14.053 |
| 41 | PEG (Mw = 1000) | 9.294 |
| 42 | PEG 9000S (Mw = 9000) | 6.395 |
| 43 | PLURONIC ® L31 Surfactant[1] | 3.812 |
| 44 | No Suppressor | 0.05 |

[1]EO/PO/EO block copolymer available from BASF, Mount Olive, NJ.

Treatment of copper seed layer with TMAH in combination with selection of an appropriate suppressor additive can be used to select a suppressor to achieve a desired feature height.

Examples 45-48

Modifying Leveler Concentration to Control Feature Height

A plurality of copper electroplating baths was prepared having the components and amounts disclosed in Table 10. The only variable component of the baths was the concentration of the leveler. One bath excluded the leveler.

TABLE 10

| Component | Amount |
|---|---|
| Copper (II) ions from copper sulfate pentahydrate | 50 g/L |
| Sulfuric acid (98 wt %) | 100 g/L |
| Chloride ions from HCl | 50 ppm |
| Bis-sodium sulfopropyl disulfide | 20 ppm |
| Diamine core-EO/PO block copolymer (Mw = 7000) | 2 g/L |
| Butyldiglycidyl/imidazole/phenylimidazole copolymer (Mw = 9200) | Variable concentration |

10 μL aliquots of an aqueous 0.25M TMAH solution with 4.2 mm diameters were applied onto a 180 nm thick copper seed layers on silicon wafers. The solutions acted on the copper seed layer surfaces for 1800 sec. The copper seed layers were then rinsed with DI water and dried under a stream of air. The seed layers were then electroplated with the copper electroplating bath of Table 8. Copper electroplating was done to achieve a target thickness of 6 μm. Copper electroplating was done at 25° C. at a current density of 2 ASD. The feature heights of the deposit plated on the solution treated areas versus the non-treated plated field were measured with an optical profilometer. The results are in Table 11.

TABLE 11

| Example | Leveler Concentration (ppm) | Feature Height (μm) |
|---|---|---|
| 45 | 0 | 17.049 |
| 46 | 0.1 | 13.536 |
| 47 | 1 | 4.288 |
| 48 | 5 | 0.812 |

Treatment of the copper seed layers with TMAH in combination with changes in the leveler concentration can be used to modify feature height.

Example 49

Circuit Pattern Printing and Selective Copper Electroplating

A circuit line pattern was printed on a 180 nm thick copper seed layer on a silicon wafer using a Fujifilm Dimatix DMP 2800 series ink-jet printer loaded with 0.25M TMAH solution with a pH=14. No patterned mask or photoresist was applied to the copper seed layer. After printing the circuit line pattern on the copper seed layer, the copper was processed in the same way as Example 4-12 using the copper electroplating bath in Example 2, Table 1. The areas of selective application of the 0.25 M TMAH solution resulted in the formation of a circuit line pattern with a line height of 6 μm. The copper seed layer which was not treated with the solution had a copper plated height of 1 μm. In addition, the copper circuit line pattern had a brighter appearance than the copper plated to a height of 1 μm. In addition to controlling plating height, the quality of the copper deposit can be controlled using the 0.25 M TMAH treatment solution.

Example 50

Selective Application of 0.25M TMAH Through a Photoresist Mask

Two silicon wafers having a layer of 180 nm thick copper seed and a 10 μm photoresist mask were obtained from IMAT INC. Vancouver, Wash., U.S.A. The PR contained a pattern of recessed features that included 50 μm wide round via openings and 30 μm wide lines. The conductive seed was only exposed at the bottom of these circuit features. A solution of 0.25 M TMAH with a pH=14 was applied to the silicon wafers with the imaged photoresist, such that the solution only made contact with the seed through the opening in the PR. After treatment, the PR in one of the wafers was removed by immersion in 1:1 DMSO:GBL mixture at 65° C. for 10 sec. The silicon wafers were then washed with DI water. The wafers were then plated with the copper electroplating bath of Example 2 in Table 1 to a target field thickness of 6 μm. Plating was done at 25° C. and at a current density of 2 ASD.

The copper plating results showed that both samples maintained the PR pattern in the plated deposit, either in the sample that still contained the PR, or in the sample where the PR had been removed prior to plating. In the latter sample, the portions of the seed where the 0.25 M TMAH solution made contact through the photoresist openings plated 2 times faster than the portions of the copper seed not treated with the solution, resulting in a feature height of 6 μm over the plated field. For the sample that contained the PR film when plated, the features also showed a plated deposit height of 6 μm inside the vias and lines. In both cases, the plated vias and lines features retained their original width of roughly 50 μm for the vias and 30 μm for the lines, even though the pattern-defining PR had been removed prior to plating. In both samples, the deposit was uniformly levelled throughout, even though the features varied in shape and size. These results show that the TMAH solution can be applied through a patterned screen to control contact with a conductive seed, and that this can be exploited to create a pattern even when the screen is removed. Furthermore, these results showed that the treatment solution can be employed to improve levelling of the plated deposit across the patterned features.

Examples 51-54 (Comparative)

TMAH vs. Accelerator Treated Copper Seed Layers

Four silicon wafers with 180 nm thick copper seed layers were treated with either 10 μL of 0.25 M TMAH aqueous solution with 100 ppm copper (II) ions at pH=5, or 10 μL of 1 g/L sodium mercaptoethylsulfonate (MES) aqueous solution at pH=5, or 10 μL of 1 g/L sodium mercaptopropylsulfonate (MPS) aqueous solution at pH=5, or 10 μL of 1 g/L bis-sodium sulfopropyl disulfide (SPS) aqueous solution at pH=5. All solutions were corrected to achieve pH 5 by the addition of sulfuric acid from a 10% sulfuric acid stock solution. The silicon wafers were then plated using with the following copper electroplating bath.

TABLE 12

| Component | Amount |
|---|---|
| Copper (II) ions from copper sulfate pentahydrate | 50 g/L |
| Sulfuric acid (98 wt %) | 100 g/L |
| Chloride ions from HCl | 50 ppm |
| Bis-sodium sulfopropyl disulfide | 20 ppm |
| TECTRONIC ™ surfactant of diamine core-EO/PO block copolymer (Mw = 7000) | 2 g/L |
| Butyldiglycidyl/imidazole/phenylimidazole copolymer (Mw = 9200) | 0.1 ppm |

The TMAH treated area plated to a height of 13.61 μm above the field, while the MES plated to a height of 43.98 μm above the field, the MPS plated to a height of 41.82 μm above the field, and the SPS treated area showed no localized plating height enhancement.

TABLE 13

| Example | Component | Rinse | Feature Height (μm) |
|---|---|---|---|
| 51 | 0.25M TMAH pH = 5 with 100 ppm Cu(II) | DI Water | 13.615 |
| 52 | 1 g/L MES pH = 5 | DI Water | 43.977 |
| 53 | 1 g/L MPS pH = 5 | DI Water | 41.824 |
| 54 | 1 g/L SPS pH = 5 | DI Water | 0 |

Examples 55-56 (Comparative)

TMAH Vs. MES Treated Copper Seed Layers

Two silicon wafers with 180 nm thick copper seed layers were treated with 10 μL of 0.25 M TMAH aqueous solution at pH=14 or 10 μL of 1 g/L MES aqueous solution also pH=14. Both silicon wafers were then washed with 10% sulfuric acid and then plated using with the following copper electroplating bath.

TABLE 14

| Component | Amount |
|---|---|
| Copper (II) ions from copper sulfate pentahydrate | 50 g/L |
| Sulfuric acid (98 wt %) | 100 g/L |
| Chloride ions from HCl | 50 ppm |
| Bis-sodium sulfopropyl disulfide | 20 ppm |
| TECTRONIC ™ surfactant of diamine core-EO/PO block copolymer (Mw = 7000) | 2 g/L |
| Butyldiglycidyl/imidazole/phenylimidazole copolymer (Mw = 9200) | 0.1 ppm |

The TMAH treated area plated to a height of 12.85 μm above the field, while the MES treated area showed no localized plating height enhancement. Acid washing, a common step in many plating protocols, did not remove the pattern formed by the TMAH treatment.

TABLE 15

| Example | Component | Rinse | Feature Height (μm) |
|---|---|---|---|
| 55 | 1 g/L MES | 10% Sulfuric Acid | 0 |
| 56 | 0.25M TMAH | 10% Sulfuric Acid | 12.853 |

Examples 57-64

Tetramethylammonium Solutions Containing Copper Oxidizers 0.25M Tetramethylammonium ion aqueous solutions containing 1-1000 ppm of dissolved copper oxidizer compounds at pH values of 2 or 5 were applied onto a 180 nm copper seed layers on silicon wafers. The contact times were 60 sec. The surfaces were then processed in the same manner as Examples 4-12. Inclusion of different oxidizers in the tetramethylammonium treatment solution increased plating speed over a TMAH treatment solution without the oxidizer. The degree of plating rate enhancement relative to Examples 4-5 (depending on the solution pH) which did not contain any extra oxidizer additive, is summarized in Table 15.

TABLE 15

(57-64)

| Compound | Copper Plating Rate Change versus Example 4 | Copper Plating Rate Change versus Example 5 |
|---|---|---|
| Nitric acid (57-58) | ×1.06 | ×1.00 |
| Sodium Persulfate (59-60) | ×3.46 | ×2.79 |
| Hydrogen Peroxide (61-62) | ×1.22 | ×1.03 |
| Iron Trichloride (63-64) | ×2.89 | ×0.85 |

What is claimed is:

1. A method comprising:

a) providing a substrate comprising copper;

b) selectively applying a composition to the copper of the substrate to increase exposed copper grains having crystal plane (111) orientations, wherein the composition consists of water, a crystal plane (111) orientation enrichment compound, optionally a pH adjusting agent, an oxidizing agent and optionally a surfactant;

c) electroplating copper on the copper of the substrate having increased exposed copper grains having crystal plane (111) orientations and field copper of the substrate with a copper electroplating bath, wherein copper electroplated on the copper treated with the composition electroplates at a faster rate than copper electroplated on the field copper; and d) anisotropic etching the copper plated on the copper of the substrate having increased exposed copper grains having crystal plane (111) orientations and simultaneously anisotropic etching the field copper, wherein the field copper is etched at a faster rate than the copper plated on the copper of the substrate having increased exposed copper grains having crystal plane (111) orientations.

2. The method of claim 1, the crystal plane (111) orientation compound is a quaternary amine.

3. The method of claim 2, wherein the quaternary amine has the formula:

(I)

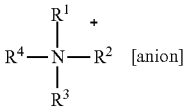

wherein $R^1$-$R^4$ are independently chosen from hydrogen, $C_1$-$C_4$ alkyl and benzyl with the proviso that up to three of $R^1$-$R^4$ can be hydrogen at the same instance.

4. The method of claim 1, wherein the oxidizing agent is a metal ion selected from the group consisting of copper (II), cerium (IV), titanium (IV), iron (III), manganese (IV), manganese (VI), manganese (VII), vanadium (III), vanadium (V), nickel (II), nickel (IV), cobalt (III), silver (I), molybdenum (IV), gold (I), palladium (II), platinum (II), iridium (I), germanium (II), bismuth (III), and mixtures thereof.

5. The method of claim 4, wherein the metal ion is copper (II) at a concentration of 1 ppm or greater.

6. The method of claim 1, where the copper electroplating bath comprises one or more sources of copper ions, a suppressor, an accelerator and optionally a leveler.

7. The method of claim 6, wherein the copper electroplating bath further comprises the leveler.

8. The method of claim 7, where a concentration of the accelerator is greater than the concentration of the leveler.

9. The method of claim 8, wherein a ratio of the concentration of the accelerator to the concentration of the leveler is 5:1 or greater.

10. The method of claim 6, wherein the suppressor has the formula:

(II)

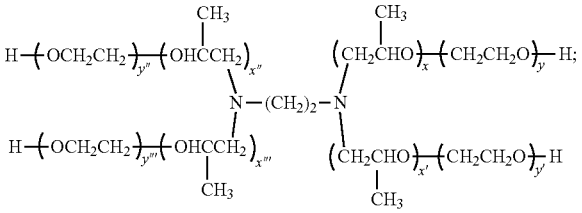

wherein a molecular weight ranges from 1000-10000 g/mol and variables x, x', x'', x''', y, y', y'' and y''' are integers greater than or equal to 1 to provide the molecular weight range of 1000-10,000 g/mol.

11. The method of claim 6, wherein the suppressor has the formula:

(III)

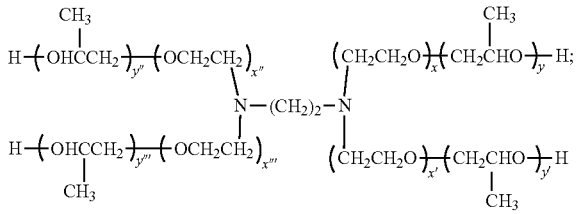

wherein a molecular weight ranges from 1000-10000 g/mol and variables x, x', x'', x''', y, y', y'' and y''' are integers greater than or equal to 1 to provide the molecular weight range of 1000-10,000 g/mol.

12. The method of claim 1, wherein the oxidizing agent is a compound selected from the group consisting of hydrogen peroxide, monopersulfates, iodates, chlorates, magnesium perthalate, peracetic acid, persulfate, bromates, perbromate, peracetic acid, periodate, halogens, hypochlorites, nitrates, nitric acid, benzoquinone, ferrocene, derivatives of ferrocene, and mixtures thereof.

* * * * *